United States Patent [19]

Giffin

[11] 3,955,084

[45] May 4, 1976

[54] ELECTRO-OPTICAL DETECTOR FOR USE IN A WIDE MASS RANGE MASS SPECTROMETER

[75] Inventor: Charles E. Giffin, Pasadena, Calif.

[73] Assignee: California Institute of Technology, Pasadena, Calif.

[22] Filed: Sept. 9, 1974

[21] Appl. No.: 504,455

[52] U.S. Cl. ..... 250/281; 250/213 VT; 250/299

[51] Int. Cl.[2] ..... H01J 39/34

[58] Field of Search ..... 250/281, 282, 283, 298, 250/299, 300, 397, 213 VT

[56] References Cited

UNITED STATES PATENTS

| | | | |
|---|---|---|---|
| 3,777,159 | 12/1973 | Hammond | 250/283 |
| 3,809,889 | 5/1974 | McBroom | 250/213 VT |

*Primary Examiner*—Craig E. Church
*Attorney, Agent, or Firm*—Lindenberg, Freilich, Wasserman, Rosen & Fernandez

[57] ABSTRACT

An electro-optical detector is disclosed for use in a wide mass range mass spectrometer (MS), in the latter the focal plane is at or very near the exit end of the magnetic analyzer, so that a strong magnetic field of the order of 1000G or more is present at the focal plane location. The novel detector includes a microchannel electron multiplier array (MCA) which is positioned at the focal plane to convert ion beams which are focused by the MS at the focal plane into corresponding electron beams which are then accelerated to form visual images on a conductive phosphored surface. These visual images are then converted into images on the target of a vidicon camera or the like for electronic processing. Due to the strong magnetic field at the focal plane, in one embodiment of the invention, the MCA with front and back parallel ends is placed so that its front end forms an angle of not less than several degrees, preferably on the order of 10°–20°, with respect to the focal plane, with the center line of the front end preferably located in the focal plane. In another embodiment the MCA is wedge-shaped, with its back end at an angle of about 10°–20° with respect to the front end. In this embodiment the MCA is placed so that its front end is located at the focal plane.

38 Claims, 8 Drawing Figures

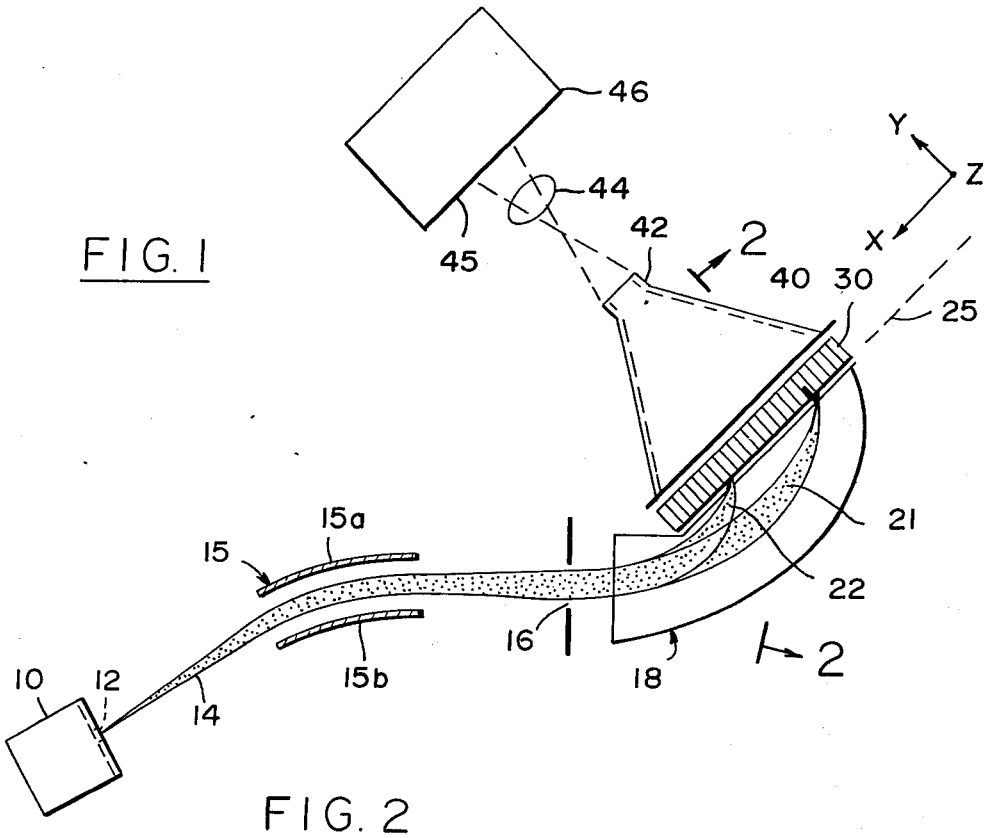
FIG. 1
FIG. 2
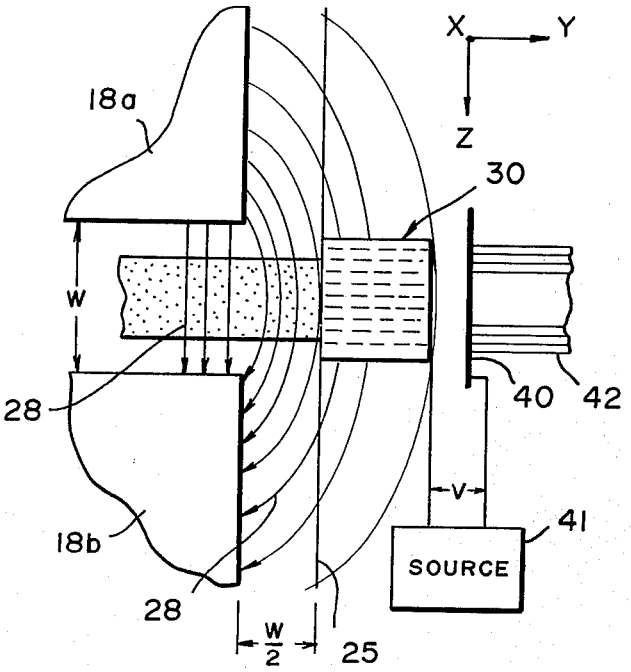
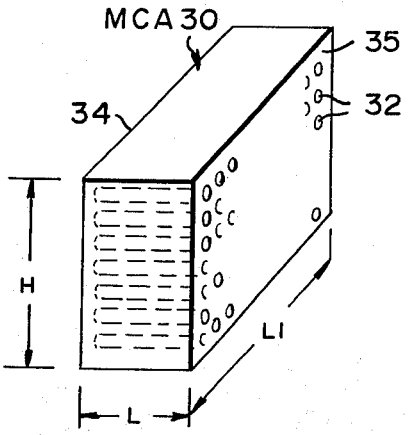
FIG. 3a
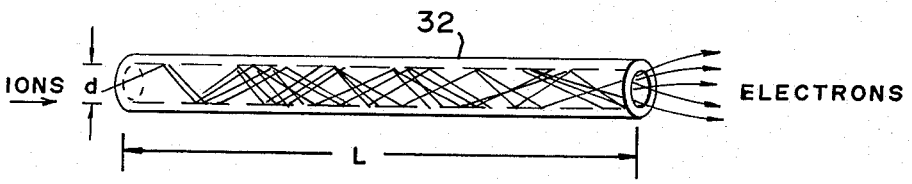
FIG. 3b

ELECTRO-OPTICAL DETECTOR FOR USE IN A WIDE MASS RANGE MASS SPECTROMETER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The present invention generally relates to the field of mass spectrometry and, more particularly, to an electrooptical detector for use at the focal plane of a mass spectrometer.

2. Description of the Prior Art

The term mass spectroscope or mass spectrometer, generally designated as an MS, is applied to a device which has the ability to separate ions according to their mass-to-charge ratios. Typically, in an MS, ions from an ion source are made to pass to a mass analyzer, consisting of an electrostatic analyzer and a magnetic analyzer. Therein they are separated into the appropriate mass-charge groups. This is achieved by the application of electric and magnetic fields. The separated ion groups in the form of separate ion beams are directed to a detector wherein they provide an indication of their presence.

Some MS's are of the type in which different ion groups are detected simultaneously. In these devices the different ion beams are brought to sharp focus at a focal plane which is at or near the exit boundary of the magnetic analyzer, at which a strong magnetic field is present. Typically, the detector is a photographic plate or simply a photoplate which is placed at the focal plane and on which the separated focused ion beams produce images.

One of the earliest and well known MS of this type is the Mattauch-Herzog MS. Although the photoplate is very suited for simultaneously detecting many ion groups or species over a wide mass range (36:1), such as 28-100 amu) with good resolution (>100 lines/mm) its utility is restricted for the following reasons. The photoplate sensitivity is low, requiring about $10^3$ to $10^4$ ions to produce a measurable line image. Also the plate's dynamic range is typically less than 30:1. In addition the time of recording is often relatively long, the plate need be inserted and removed from the evacuated chamber of the MS. Also, after exposure, it has to be developed, as a conventional photographic negative, and thereafter a densitometer must be used to analyze the exposed plate.

In order to overcome the disadvantages of the photoplate as the detector, electronic detection systems have been developed. These electronic detectors are designed to increase the detection sensitivity and/or shorten the time required to collect both qualitative and quantitative analytical results and simplify the associated data reduction problems. To date these devices have only been used in MSs of the scanning type in which different ion groups are successively swept through a single slit by varying the electrostatic or magnetic field. The slit is located at a focal point which is typically remote from and, therefore, not within the magnetic field. As the electrostatic or magnetic field is varied different ion groups are bent so that their beams successively exit through the slit. At any time only a single beam exits the slit. Nier's double-focusing MS is typical of such an MS, as described in "Mass Spectrometry" by Charles A. McDowell, Library of Congress Catalog Card Number 62-22201.

The electronic detector typically consists of an electron multiplier. Ions which pass through the slit enter the electron multiplier and produce secondary electrons which are then detected to indicate the presence of the ion beam at the slit. In spite of the inherent high sensitivity of the electron multiplier, which is capable of producing on the order of $10^3$–$10^8$ electrons per ion, and the popularity of the electronic detector it also has a number of severe limitations.

The most important of these is a loss of sensitivity by 4 to 6 orders of magnitude due to the limited observation time for the sample as a whole, as well as each ionic group of species of the spectrum. Since the sample pressure in an ion source may vary rapidly with time (as it emerges from a solid probe, a gas chromatograph interface, etc.) only about 1/10th of the sample passing through the ion source can be used to obtain a representative spectrum (scanned in a time short enough for concentration changes not to occur) and only 1 ion in $10^3$–$10^5$ is collected as one scans a typical spectrum. Consequently, today's electronic detection methods in the scanning mode are no more sensitive than the old photographic methods. The awkwardness of processing the photographic plate has been replaced by the requirements of using special techniques in initiating scans at the proper time where spectra of small transient samples are to be recorded.

Recently, an electro-optical detection system has been proposed for use in a magnetic sector MS, in which the mass range of the ion groups which are simultaneously detected is very narrow, generally in the order of not more than ±10%, or a mass range of 1.1:1. In such a magnetic sector MS the focal plane is also outside the magnetic field of the MS analyzer. The proposed electro-optical detector includes a microchannel electron multiplier array (hereinafter defined as MCA) which is used as a primary ion-electron converter. The MCA is located at the focal plane which is outside the magnetic field. It is electro-optically coupled to a high resolution metallized phosphored screen or plate which is deposited onto a fiber optical coupler to a vidicon camera tube.

The proposed electro-optical detector operates quite satisfactorily in the magnetic sector MS, thereby eliminating the problems inherent in the use of the photoplate as the detector. However, the magnetic sector MS is of limited application since it can only be used to detect simultaneously ion groups over a very narrow mass range.

Attempts to adapt the above-described electro-optical detector for use in a wide mass range MS such as the Mattauch-Herzog MS by placing the MCA at the MS's focal plane, whereat the photoplate is conventionally placed, have failed. The failure is due to the fact that at the focal plane of a Mattauch-Herzog type MS strong transverse magnetic fields are present. These, combined with an orthogonal electrostatic field needed to accelerate the secondary electrons to the phosphor plate inhibit the electrons from ever reaching the phosphor plate to produce an image thereat. The electrons which exit the MCA in the presence of the strong magnetic field undergo a cycloidal motion between the MCA and the phosphored plate, never reaching the latter, unless the magnetic field of the MS is greatly reduced, at the price of reduced mass range operability. Thus, a need exists for an improved electro-optical detector for use in an MS capable of simultaneously detecting many ion species over a wide mass range, such as the Mattauch-Herzog MS.

OBJECTS AND SUMMARY OF THE INVENTION

It is a primary object of the present invention to provide a new electro-optical detector for use in a MS in which ion beams are focused at a focal plane at which a strong magnetic field is present.

Another object of the present invention is to provide a new electro-optical detector for use in a Mattauch-Herzog type MS, instead of a photoplate conventionally placed at the focal plane of the MS.

A further object of the present invention is to provide a new electro-optical detector for use in a wide mass range MS wherein a strong magnetic field on the order of several thousand gauss (G) is present at the focal plane at which different ion beams focus.

These and other objects of the invention are achieved by providing an electro-optical detector which includes a MCA, and a spaced apart conductive phosphored plate. In one embodiment the MCA is positioned at an angle with respect to the focal plane in an MS where the focal plane is within a strong magnetic field, so that despite the influence of the magnetic and electrostatic fields secondary electrons, exiting the MCA, reach the phosphored plate to form images thereat. In another preferred embodiment the MCA is wedge-shaped in that the input ends of all the micro channels in the array are in a front plane which is at an angle with back plane at which the output ends of all the channels are located.

In either embodiment the electrons exit the MCA at an angle, other than 90°, with respect to the magnetic field. As a result even though the exiting electrons are to a degree influenced by the magnetic field they are sufficiently accelerated by the electrostatic field to reach the phosphor plate and form images thereat.

The novel features of the invention are set forth with particularity in the appended claims. The invention will be best understood from the following description when read in conjunction with the accompanying drawings.

BRIEF DESCRIPTION OF THE DRAWINGS

FIG. 1 is a simple cross-sectional diagram of the electro-optical detector of the present invention, and the type of MS in which it is used;

FIG. 2 is a cross-sectional diagram along line 2—2 in FIG. 1;

FIGS. 3*a* and 3*b* are diagrams of a micro-channel electron multiplier array (MCA) used in one embodiment of the invention;

DESCRIPTION OF THE PREFERRED EMBODIMENTS

Figure 4:
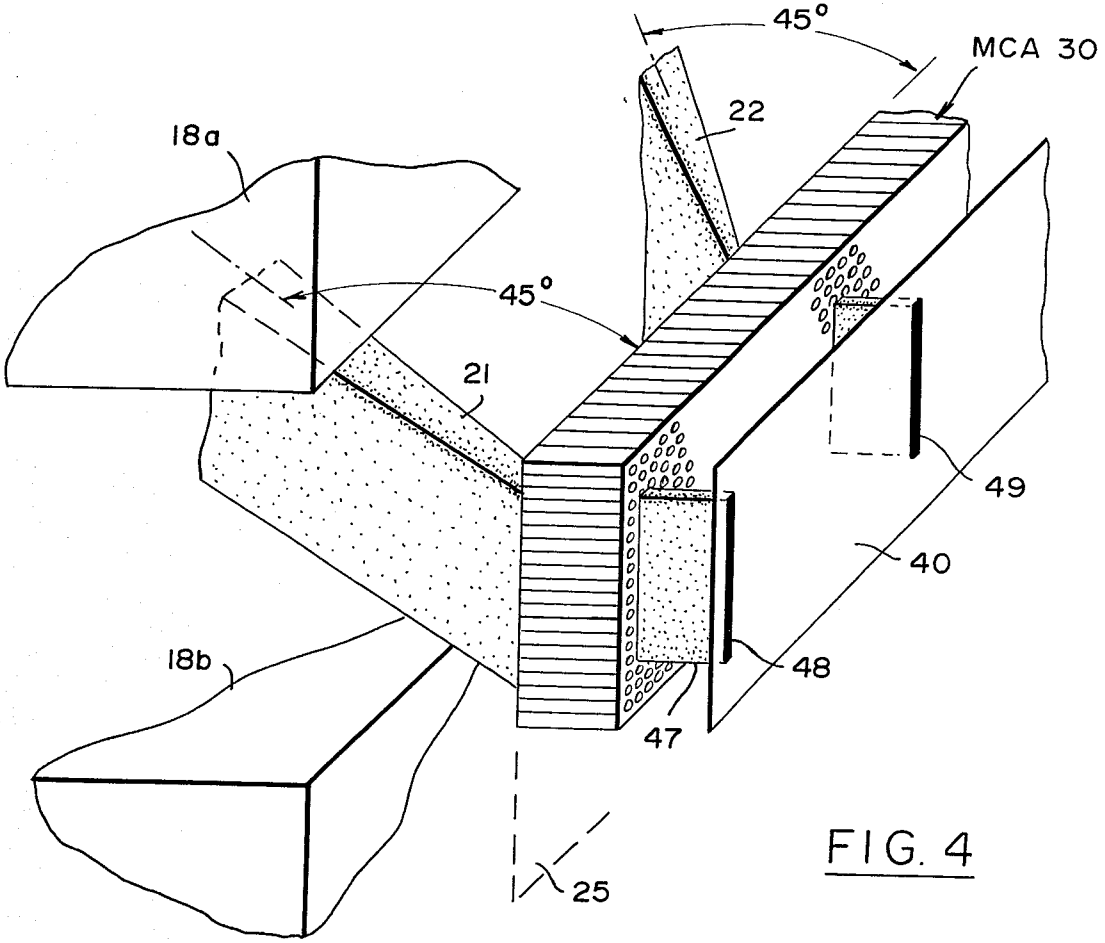
FIGS. 4 and 5 are diagrams useful in explaining the operation of the detector in the theoretical absence and actual presence of a stray magnetic field at the MS focal plane.

Attention is first directed to FIG. 1 which is a simple schematic representation of the detector of the present invention and the type of MS in which it is designed for use. In FIG. 1 numeral 10 represents an ion source with a slit 12 through which ions of different mass-to-charge ratios exit in the form of a single ion beam 14. This ion beam passes through an electrostatic analyzer 15, represented by plates 15*a* and 15*b* and therefrom through a slit 16 to a magnetic analyzer 18. Therein the ion beam 14 is separated into separate ion beams, each of the latter containing a different group of ions of the same mass-to-charge ratio. For explanatory purposes only two separated ion beams 21 and 22 are shown as being brought to focus at a focal plane 25. As shown, the latter is at or very near the exit end of the magnetic analyzer 18.

The arrangement, described so far, is that of a Mattauch-Herzog MS in which the focal plane 25 is at the exit end of the magnetic analyzer or that of a Robinson-modified Mattauch-Herzog MS in which the focal plane is approximately one-half gap width external to the pole pieces of the magnetic analyzer. In FIG. 2 which is a cross-sectional view along lines A—A the pole pieces are designated by numerals 18*a* and 18*b*, the gap between them by W and the distance of the focal plane from the pole pieces by W/2. The gap height W is typically on the order of 8mm. In a conventional Mattauch-Herzog MS this distance is extremely small. For all practical purposes the focal plane 25 is assumed to be at the exit end of the magnetic analyzer.

In such an MS designed to simultaneously detect many ions over a wide mass range, e.g., 36:1, a very strong magnetic field on the order of 10–12KG and represented by arrows 28 is present in the gap. The magnetic fringe field at and near the focal plane 25 is about ½ that in the gap, i.e., on the order of 5–6KG. As shown in FIG. 2 the magnetic field in the gas as well as about the focal plane 25 is transverse to the direction of focused beam 21 (or 22). The focal plane is assumed to be in an XZ plane, the magnetic field 28 is in the Z axis, which is in the XZ plane. The beams 21, 22 are focused at the focal plane along the X axis. As is known, these beams strike the focal plane 25 at an angle which is less than 90° at different locations along the X axis in the focal plane. In the Mattauch-Herzog MS the angle is 45°.

Conventionally, a photoplate is placed at the focal plane and is exposed by the different focused ion beams thereby providing images which are spaced apart along the X axis. With a photoplate 36cm long in the X axis ions over a range of 36:1 mass-to-charge ratio can be simultaneously focused on the plane, with a resolution of >100 lines/mm. The photoplate is not affected by the transverse magnetic field (in the Z axis) and therefore the relatively strong field at the focal plane does not affect the exposure of the photoplate. However, this field when combined with an electrostatic field is of major concern and influence on the detector of the present invention, unless special steps are taken to account for its presence.

The detector of the present invention includes a microchannel electron multiplier array (MCA) designated by numeral 30, one embodiment of which is shown in FIG. 3*a*. It is a semiconductor plate with spaced apart parallel hollow cylindrical channels 32, one of which is shown in FIG. 3*b*. At present MCA's are available with 10$\mu$m channel diameters (d) spaced about 12$\mu$m center-to-center. The length L of the channels from the MCA's front end or plane 34 at which the input ends of the channels are disposed to a back end or plane 35 at which the channels' output ends are disposed is chosen to be about 40*d* or greater. That is, L/d 40. In FIG. 3*a* the MCA is shown with the front and back ends parallel to one another. Such an MCA is used in one embodiment of the invention. The length L of the channels actually corresponds to the width or thickness of the MCA. Its length is designated by L1 and its height by H.

As is appreciated, when an appropriate potential typically on the order of 1KV is applied between the front and back ends of the MCA ions entering a channel through the front end produce secondary electrons which exit the back end as shown in FIG. 3*b*. Thus, the MCA is actually an ion-to-electron converter. Electron gain values on the order of $10^4$ are achievable with presently available MCAs.

As shown, the MCA is positioned so that its front end 34 faces the pole pieces and the length of the MCA is along the X axis. Briefly, the function of the MCA is to convert the ion beams 21, 22, etc., which come to focus at the focal plane into separate electron beams of cross-sections, which are similar to those of the focused ion beams, and which exit the MCA through its back end. A conductive phosphored plate 40 is positioned a very short distance, e.g., 1mm from the back end, parallel thereto. The phosphored plate may comprise a glass plate coated with a conductive layer which is in turn coated with a layer of phosphorous material. The electron beams which exit the MCA strike the plate 40 forming fluorescent or visual images thereat, which correspond to the original ion beams. Since the electrons exit the MCA at low velocity a potential source 41 is used to apply a voltage V of about 1–3KV/mm between the MCA and the plate 40, to accelerate the electron beams thereto. The visual images on plate 40 which are analogous to the images produced on the conventional photoplate and represent the mass spectral data, are transferred by means of optical fibers or rods 42, generally referred to as fiber optics, and a lens 44 to the target 45 of a vidicon camera 46. The latter is scanned after a sufficient integration time to supply the mass spectral data which is on the target to a computer or other data handling system as voltage versus time.

As previously pointed out the fringe magnetic field at the focal plane is on the order of 5–6KG. If this strong magnetic field were not present at the focal plane, the MCA with the parallel front and back ends could be positioned as shown in FIG. 4 with the front end 34 located at the focal plane in place of the conventional photoplate. Since beam 21 is focused at the focal plane, its cross section impinging the front end would be a narrow rectangle or simply a line. The ions in the focused beam would enter channels in the MCA to form electrons which would exit the MCA's back end 35 and form an electron beam 47 with a rectangularly shaped cross-section. The electron beam would finally impinge the phosphor plate 40 and form a line (or narrow rectangle) visual image 48 thereon. Similarly, the impingement of a second focused ion beam, such as beam 22, on the front end of the MCA will result in another sharp line visual image 49 on the phosphor plate. These images 48 and 49 would be identical to those produced on the conventional photoplate. However, since these images are on the phosphor plate they lend themselves to electro-optical processing, thus, eliminating the processing problems associated with an exposed photoplate.

However, in reality due to the strong magnetic field at the focal plane, placing the MCA with parallel front and back ends, as shown in FIG. 4, does not result in the production of images 48 and 49. What actually happens may best be explained in connection with FIG. 5. As shown the electron beam 47 which is produced by the MCA in response to the focused ion beam 21, rather than accelerating to the phosphor plate 40 is influenced by the magnetic field in the Z axis and the orthogonal electrostatic field (V) in the Y axis and therefore undergoes a cycloidal motion in the X axis which is perpendicular to the YZ plane. The electron beam 47 may return back to the MCA or undergo several cycloidal turns as represented by line 50. However, in either case the electron beam 47 does not reach the phosphor plate. Thus, image 48 is not produced thereon.

Figure 5:
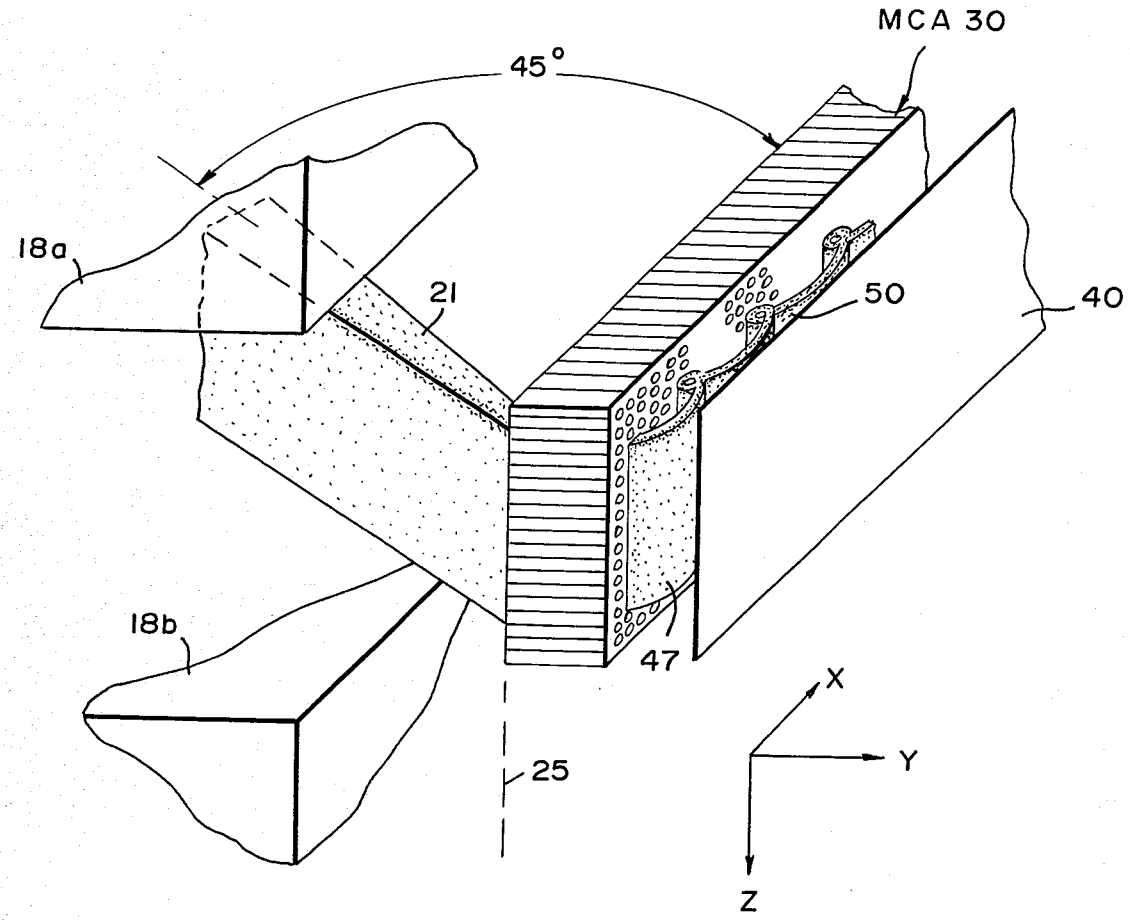
Figure 6:
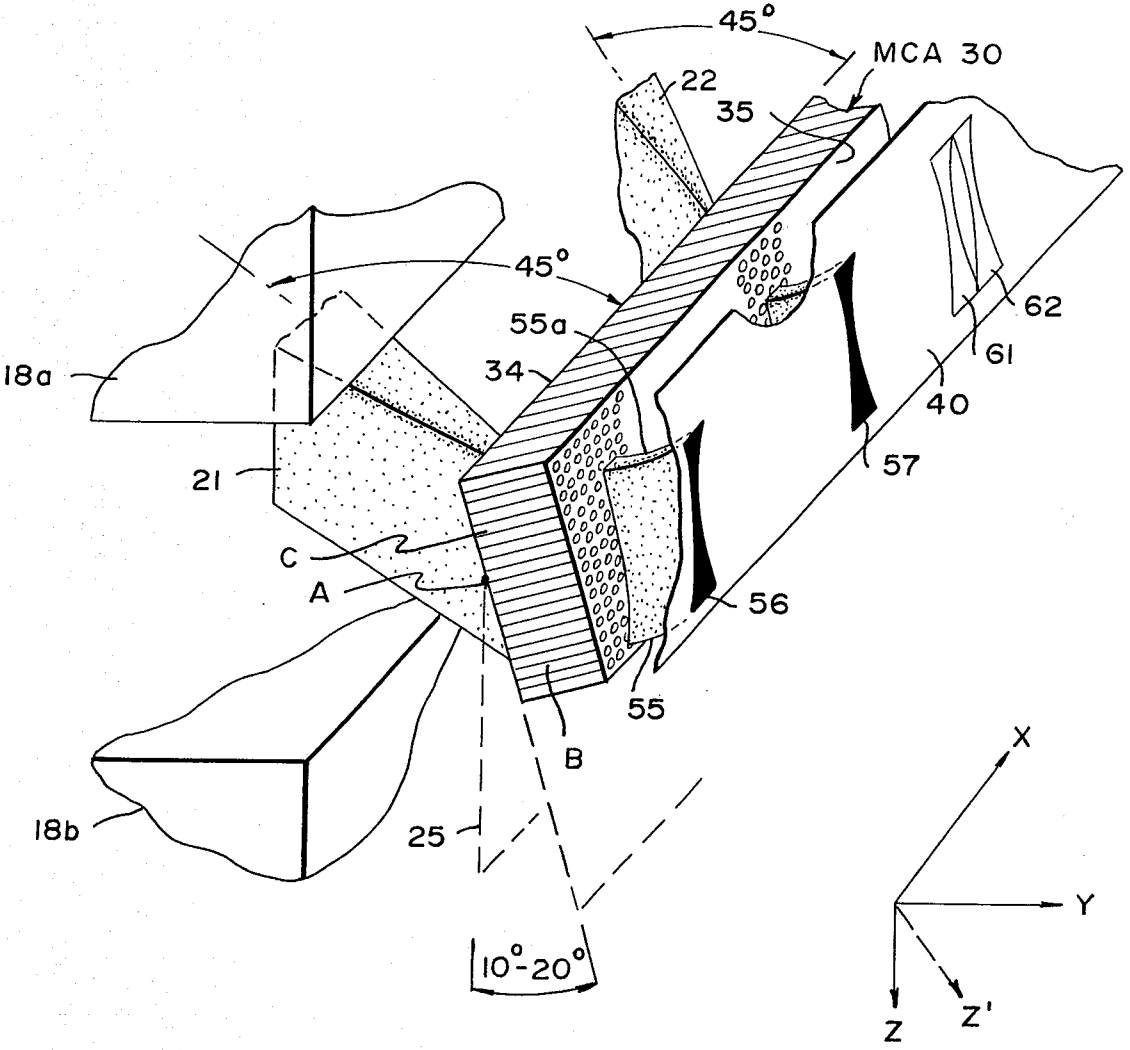
FIG. 6 is a diagram showing the positioning of the detector in accordance with one embodiment of the invention.

In accordance with one embodiment of the present invention the MCA, shown in FIG. 3*a*, with the front and back ends 34 and 35 parallel to one another rather than being positioned at the focal plane with the front end coinciding with the focal plane, as shown in FIG. 5 is positioned at an angle with respect to the focal plane as shown in FIG. 6. The inlet ends of the channels along the MCA center line as represented by A lie in the focal plane while those below A, represented by B lie beyond the focal plane and those above A, represented by C lie in front of the focal plane. Preferably the angle between the focal plane and the MCA front end should be not less than 10°, e.g., 10–20°. It is thus seen that in accordance with the invention the MCA's front and back ends do not lie in the XZ plane which is parallel to the magnetic field in the Z axis. Rather, the MCA lies in an XZ′ plane which is other than parallel to the Z axis. The phosphored plate 40 is placed parallel to the back end 35 which, being parallel to the front end 34, also forms an angle with respect to the focal plane.

With such an arrangement, the cross section of the electron beam 55 which exits the MCA is not a line or a narrow rectangle. Rather, it is broader at the top and bottom than in the middle due to the fact that ions of the beam 21 enter more channels C which are ahead of the focal plane where the beam is broader since it is not yet in focus and more channels C which are beyond the focal plane, where the beam diverges after being focused, than channels A which are at the focal plane where the ion beam is focused. Also, the electron beam cross section as viewed at the back end is somewhat rotated clockwise (see FIG. 6) due to the fact that the ion beam is directed to the focal plane at an angle which is other than 90°, e.g., 45° and the front end 34 of the MCA is at an angle other than 0° with respect to the Z axis.

As the electron beam 55 exits the MCA it is subjected to the influence of the magnetic and electrostatic fields. However, since its direction is no longer in the Y axis which is perpendicular to the magnetic field in the Z axis it reaches the phosphored plate and forms an image 56 thereat. It should be pointed out that the beam tends to be translated upwardly as well as along the X axis under the influence of the magnetic and electrical fields, as represented by curved line 55*a*. However, in spite of these forces the image 56 is formed in the phosphored plate. A similar image 57 is shown on the plate for another ion beam such as 22 striking the MCA at a different position along its length. The visual images on the phosphor plate are then transferrable by the fiber optics to the vidicon camera target for electronic processing, as hereinbefore described.

From the foregoing it should thus be apparent that in accordance with the present invention a novel electro-optical detector is provided which is to replace the photoplate detector, conventionally used in a MS of the type in which many ion groups are simultaneously detectable over a wide mass range, and in which the focal plane is at the exit end of the magnetic analyzer, where the magnetic fringe field is relatively strong, on the order of several KG, e.g., 5–6KG. The only possible disadvantage of the detector hereinbefore described over the conventional photoplate is that in the latter the images are sharp lines or narrow rectangles while in the detector of the invention, due to the angle of the MCA with respect to the focal plane, the images are not of uniform width. Each image in the phosphor plate is wider at its ends than in the middle. If in operation two ion beams are provided for ions with small differences between their mass-to-charge ratios, i.e., ions with very close atomic mass units or amu's, their images are very close to one another on the phosphor plate. Therefore their wider top and bottom ends may overlap as shown in FIG. 6 for images 61 and 62. This would result in reduced resolution, unless the original ion beams were greatly reduced in height by reducing the height of slits 12 and 16 shown in FIG. 1. This is undesirable, since it reduces the number of ions which are actually detected.

Figure 7:
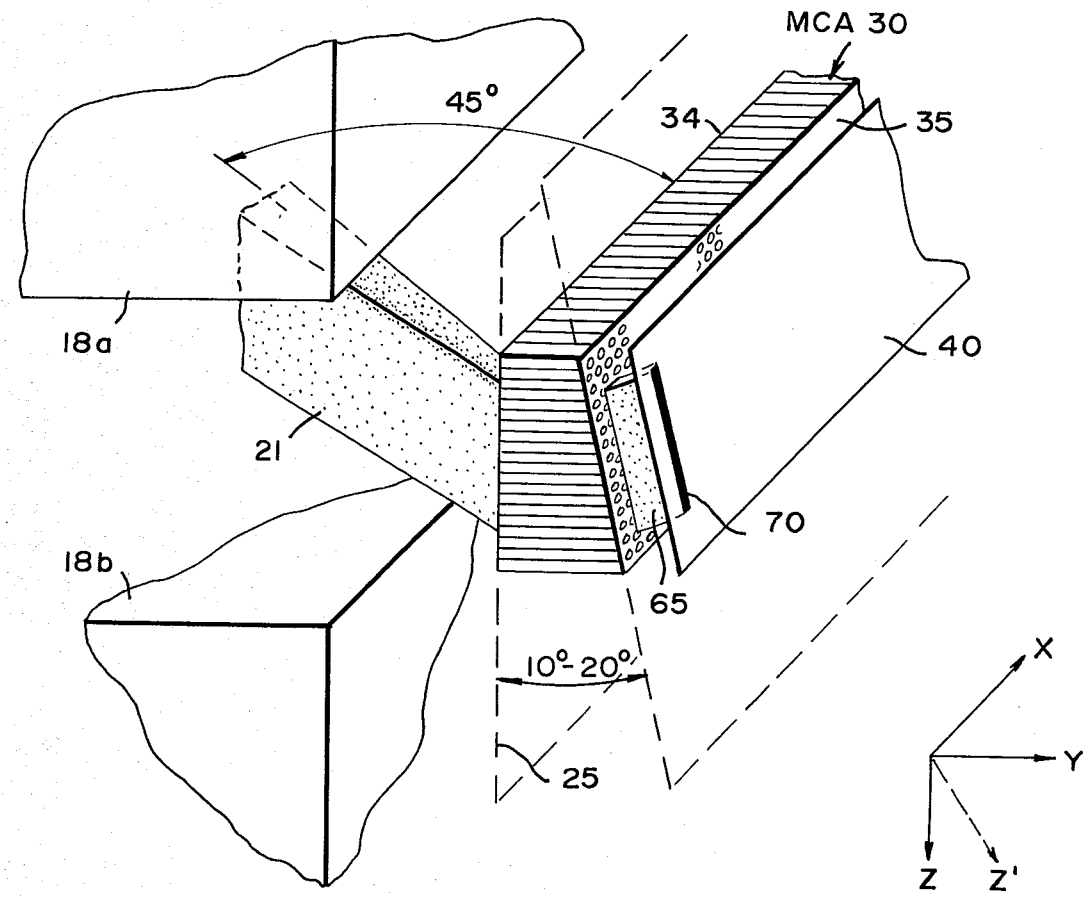
FIG. 7 is a diagram of another embodiment of the invention.

This potential loss in resolution is eliminated by another embodiment of the invention in which the MCA, rather than having its front and back ends 34 and 35 parallel to one another, as shown in FIG. 3*a*, is wedge-shaped, as shown in FIG. 7. In this embodiment the back end 35 is a plane which is at an angle, e.g., 10°–20° with respect to the plane of the front end 34. The phosphor plate 40 is spaced apart and parallel to the back end.

In this embodiment the MCA is positioned so that its front end 34 lies in the focal plane, in the exact location at which a conventional photoplate is generally located. Thus, the ion beam 21 impinges thereon as a narrow line or rectangle. Consequently, the seondary electrons which exit the MCA form a beam 65 with a narrow rectangle cross section. This cross section is the same as the cross section of the focused beam striking the MCA's front end at the focal plane, and therefore is practically identical to the line image which would have been formed on a photoplate, placed at the focal plane. As this beam travels from the MCA back end due to the magnetic and electric fields, as hereinbefore described, the beam tends to be translated along the X axis and pulled upwardly. However, its narrow rectangular cross section is not altered and therefore strikes the phosphored plate and forms a visual image 70 thereat, which is in the shape of a narrow rectangle or line, which is of uniform width.

In the MS ion beams are focusable at the focal plane with a high resolution of 100 lines or images per mm. With present day MCA's with channel diameters of 10$\mu$m and 12$\mu$m center-to-center and with fiber optical rods down to 6$\mu$m a resolution of about 40 images/mm is possible. If MCA's with channel spacings of 5$\mu$m center-to-center a resolution of 100 lines/mm would be obtainable.

In a commercial Mattauch-Herzog MS or one modified by Robinson, the photoplate length in the X axis is typically on the order of 36cm in order to simultaneously record images of ion beams over a wide mass range. At present the lengths of available MCA's are considerably shorter than that. Thus, several abutting MCA's may be placed in the X axis to provide sufficient MCA length. Assuming an ion beam height of approximately 0.4mm, usual images would be producable on the phosphor plate over an area of 0.4 × 360  144 sq. mm. The area of the active target 45 (see FIG. 1) of a typical vidicon camera 46 is 1.27cm × 1.27cm square or about 151 sq. mm incorporating 2.5 × $10^5$ picture elements. The fiber optics 42 together with lens 44 are used to accommodate the radially different geometrics. Twenty-eight folds of the fiber optics are required to project the images in 28 different rows on the target area. Although, hereinbefore the phosphored plate 40** was referred to as a discrete element, separate from the fiber optics, it should be appreciated that the front tips of the fibers rods can be coated with a phosphorous material, so that the bunched tips together are in a common plane representing a phosphor plate.

From the foregoing, it is thus seen that in accordance with the present invention an electro-optical detector is provided for use in a wide mass range MS in which the focal plane is at or very near the exit end of the magnetic analyzer, so that a strong magnetic field of the order of 1000G or more is present at the focal plane location. The novel detector includes a MCA which is positioned at the focal plane to convert ion beams which are focused by the MS at the focal plane into corresponding electron beams which are then accelerated to form visual images on a phosphor surface. These visual images are then converted into images on the target of a vidicon camera or the like for electronic processing. Due to the strong magnetic field at the focal plane, in one embodiment of the invention, the MCA with front and back parallel ends is placed so that its front end forms an angle of not less than about 10°, e.g.,10°–20° with respect to the focal plane, with the center line of the front end preferably located in the focal plane. In another embodiment the MCA is wedge-shaped, with its back end at an angle of about 10°–20° with respect to the front end. In this embodiment the MCA is placed so that its front end is located at the focal plane.

It should be pointed out that the invention may be used in any spectrometer in which charged particles, e.g., electrons or positive or negative ions are focused at a focal plane, whereat a relatively strong magnetic field, assumed herein to be not less than 1000G, is present. For example, it can be used with a 180° magnetic deflection $\beta$ ray spectrometer.

Although particular embodiments of the invention have been described and illustrated herein it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. An electro-optical detector for use with a mass spectrometer of the type focusing ion beams at a focal plane at substantially the exit end of a magnetic analyzer at which a magnetic field is present, the detector comprising:

a microchannel electron multiplier array, defining a plurality of parallel hollow channels each with an inlet end and an outlet end, all of said inlet ends being in a first plane defining a front end of said array and the outlet ends being in a second plane defining a back end of said array, said array being located at said focal plane so that the front end faces said magnetic analyzer and at least said back end is at an angle with respect to said focal plane, whereby ions in said ion beams enter channels in said array through the inlet ends thereof, producing secondary electrons therein, said secondary electrons exiting said channels through said back end forming electron beams; and circuit means including electron-sensitive means spaced apart from the array back end and parallel thereto for intercepting each of said electron beams to form an image thereon and means for processing the images formed on said electron-sensitive means.

2. An electro-optical detector as described in claim 1 wherein said angle is on the order of not less than 10°.

3. An electro-optical detector as described in claim 2 wherein said ion beams are of a selected height, and the beams are focused at said focal plane at different locations along a first axis, and said array being of a height not less than the height of the ion beams, with its length parallel to said first axis, with at least the center of said front end along the array length being in said focal plane.

4. An electro-optical detector as described in claim 1 wherein said front and back ends of said array are parallel to one another, with said front end defined by the height and length of said array, forming said angle with said focal plane with the center of said front end along the array length being located in said focal plane, whereby the inlet ends of channels along said center lie in said focal plane with the inlet ends of channels above and below said center being either ahead or beyond said focal plane.

5. An electro-optical detector as described in claim 4 wherein said angle is on the order of not less than 10°.

6. An electro-optical detector as described in claim 4 wherein said electron-sensitive means define a phosphorous surface substantially parallel to said back end and spaced apart therefrom, and said circuit means include means for accelerating said electrons exiting said array through said back end to said phosphorous surface.

7. An electro-optical detector as described in claim 1 wherein said back end forms said angle with respect to said front end and said array is wedge-shaped, with the front end of said array being located substantially at said focal plane.

8. An electro-optical detector as described in claim 7 wherein said electron-sensitive means define a phosphorous surface substantially parallel to said back end and spaced apart therefrom a distance on the order of not less than one millimeter, and said circuit means include means for accelerating said electrons exiting said array through said back end to said phosphorous surface.

9. An electro-optical detector as described in claim 7 wherein said angle is on the order of not less than 10°.

10. An electro-optical detector as described in claim 1 wherein said magnetic field at said focal plane is on the order of not less than 1000 gauss (G).

11. An electro-optical detector as described in claim 10 wherein said ion beams are focused at said focal plane at different locations along a first axis with the magnetic field at said focal plane being in a second axis perpendicular to said first axis, with the array length being disposed parallel to said first axis, with at least the center line in said front end along the array length being in said focal plane.

12. An electro-optical detector as described in claim 11 wherein said front and back ends of said array are parallel to one another, with said front end defined by the height and length of said array, forming said angle with said focal plane with the center of said front end along the array length being located in said focal plane, whereby the inlet ends of channels along said center lie in said focal plane with the inlet ends of channels above and below said center being either ahead or beyond said focal plane.

13. An electro-optical detector as described in claim 12 wherein said angle is on the order of not less than 10°.

14. An electro-optical detector as described in claim 11 wherein said back end forms said angle with respect to said front end and said array is wedge-shaped, with the front end of said array being located substantially at said focal plane.

15. An electro-optical detector as described in claim 14 wherein said angle is on the order of not less than 10°.

16. An electro-optical detector as described in claim 15 wherein said electron-sensitive means define a phosphorous surface substantially parallel to said back end and spaced apart therefrom, and said circuit means include means for accelerating said electrons exiting said array through said back end to said phosphorous surface.

17. An electro-optical detector as described in claim 1 wherein said means for processing comprise means for converting the images on said electron-sensitive means into electrical signals.

18. An electro-optical detector as described in claim 17 wherein said means for processing comprise vidicon means having a target exposable to images and means for converting the images on said target into related electrical signals, and means for transferring the images formed on said electron-sensitive means to the target of said vidicon means.

19. An electro-optical detector as described in claim 18 wherein said ion beams are focused at said focal plane at different locations along a first axis with the magnetic field at said focal plane being in a second axis perpendicular to said first axis, with the array length being disposed parallel to said first axis, with at least the center line in said front end along the array length being in said focal plane.

20. An electro-optical detector as described in claim 19 wherein said front and back ends of said array are parallel to one another, with said front end defined by the height and length of said array, forming said angle with said focal plane with the center of said front end along the array length being located in said focal plane, whereby the inlet ends of channels along said center lie in said focal plane with the inlet ends of channels above and below said center being either ahead or beyond said focal plane.

21. An electro-optical detector as described in claim 20 wherein said angle is on the order of not less than 10° and the magnetic field at said focal plane is on the order of not less than 1000 gauss (G).

22. An electro-optical detector as described in claim 19 wherein said back end forms said angle with respect to said front end and said array is wedge-shaped, with the front end of said array being located substantially at said focal plane.

23. An electro-optical detector as described in claim 22 wherein said angle is on the order of not less than 10° and the magnetic field at said focal plane is on the order of not less than 1000 gauss (G).

24. An electro-optical detector for use in a device in which separate beams of charged particles are focusable at different locations along a longitudinal axis in a focal plane which is in a magnetic field which is substantially in a direction perpendicular to said longitudinal axis, the detector comprising:

a microchannel electron multiplier array, defining a plurality of parallel hollow channels each with an inlet end and an outlet end, all of said inlet ends being in a first plane defining a front end of said array and all the outlet ends being in a second plane defining a back end of said array, said array being positioned with its front end toward said separate beams with the array length parallel to said longitudinal axis, whereby the particles of different beams enter different groups of channels to generate secondary electrons, which exit the channels through said back end and forming separate electron beams, the array being positioned whereby at least its back end is at an angle with respect to said focal plane with at least the inlet ends of channels along a center line of said front end extending along the array length, being in said focal plane; and circuit means including electron-sensitive means which are parallel to said back end and spaced apart therefrom for intercepting said electron beams which form images thereon and means for processing said images, each image corresponding to a different charged particles' beam.

25. An electro-optical detector as described in claim 24 wherein said magnetic field at said focal plane is on the order of not less than 1000 gauss (G) and said angle is on the order of not less than 10°.

26. An electro-optical detector as described in claim 24 wherein said front and back ends of said array are parallel to one another, with said front end defined by the height and length of said array, forming said angle with said focal plane with the center of said front end along the array length being located in said focal plane, whereby the inlet ends of channels along said center lie in said focal plane with the inlet ends of channels above and below said center being either ahead or beyond said focal plane.

27. An electro-optical detector as described in claim 26 wherein said magnetic field at said focal plane is on the order of not less than 1000 gauss (G) and said angle is on the order of not less than 10°.

28. An electro-optical detector as described in claim 27 wherein said electron-sensitive means define a phosphorous surface substantially parallel to said back end and spaced apart therefrom, and said circuit means include means for accelerating said electrons exiting said array through said back end to said phosphorous surface.

29. An electro-optical detector as described in claim 24 wherein said back end forms said angle with respect to said front end and said array is wedge-shaped, with the front end of said array being located substantially at said focal plane.

30. An electro-optical detector as described in claim 29 wherein said magnetic field at said focal plane is on the order of not less than 1000 gauss (G) and said angle is on the order of not less than 10°.

31. An electro-optical detector as described in claim 30 wherein said electron-sensitive means define a phosphorous surface substantially parallel to said back end and spaced apart therefrom a distance on the order of not less than one millimeter, and said circuit means include means for accelerating said electrons exiting said array through said back end to said phosphorous surface.

32. An electro-optical detector as described in claim 24 wherein said means for processing comprise means for converting the images on said electron-sensitive means into electrical signals.

33. An electro-optical detector as described in claim 32 wherein said means for processing comprise vidicon means having a target exposable to images and means for converting the images on said target into related electrical signals, and means for transferring the images formed on said electron-sensitive means to the target of said vidicon means.

34. An electro-optical detector as described in claim 33 wherein said ion beams are focused at said focal plane at different locations along a first axis with the magnetic field at said focal plane being in a second axis perpendicular to said first axis, with the array length being disposed parallel to said first axis, with at least the center line in said front end along the array length being in said focal plane.

35. An electro-optical detector as described in claim 34 wherein said front and back ends of said array are parallel to one another, with said front end defined by the height and length of said array, forming said angle with said focal plane with the center of said front end along the array length being located in said focal plane, whereby the inlet ends of channels along said center lie in said focal plane with the inlet ends of channels above and below said center being either ahead or beyond said focal plane.

36. An electro-optical detector as described in claim 35 wherein said angle is on the order of not less than 10° and the magnetic field at said focal plane is on the order of not less than 1000 gauss (G).

37. An electro-optical detector as described in claim 34 wherein said back end forms said angle with respect to said front end and said array is wedge-shaped, with the front end of said array being located substantially at said focal plane.

38. An electro-optical detector as described in claim 37 wherein said angle is on the order of not less than 10° and the magnetic field at said focal plane is on the order of not less than 1000 gauss (G).

* * * * *

UNITED STATES PATENT OFFICE

CERTIFICATE OF CORRECTION

Patent No. 3,955,084 Dated May 4, 1976

Inventor(s) Charles E. Giffin

It is certified that error appears in the above-identified patent and that said Letters Patent are hereby corrected as shown below:

Column 1, line 43, delete right parenthesis ")" after "1".

Column 3, line 55, "2-22" should be "2-2".

Column 5, line 8, after "L/d" insert "$\geq$".

Column 7, line 64, after "of" insert "$\geq$".

Column 8, line 12, delete "**" and insert "$\approx$".

Signed and Sealed this

Seventh Day of September 1976

[SEAL]

*Attest:*

RUTH C. MASON
*Attesting Officer*

C. MARSHALL DANN
*Commissioner of Patents and Trademarks*